US008922273B2

(12) United States Patent
Na et al.

(10) Patent No.: US 8,922,273 B2
(45) Date of Patent: Dec. 30, 2014

(54) INTERNAL VOLTAGE GENERATOR

(75) Inventors: Hyoung-Jun Na, Gyeonggi-do (KR); Kyung-Whan Kim, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 943 days.

(21) Appl. No.: 12/494,681

(22) Filed: Jun. 30, 2009

(65) Prior Publication Data

US 2010/0315157 A1 Dec. 16, 2010

(30) Foreign Application Priority Data

Jun. 16, 2009 (KR) ..... 10-2009-0053511

(51) Int. Cl.
*G05F 1/10* (2006.01)
*G05F 1/56* (2006.01)

(52) U.S. Cl.
CPC ..... *G05F 1/56* (2013.01)
USPC ..... 327/543; 327/538; 327/539; 323/313

(58) Field of Classification Search
USPC ..... 327/538–546; 323/313, 314
See application file for complete search history.

(56) References Cited

U.S. PATENT DOCUMENTS 7,250,811 B2 * 7/2007 Kim ..... 327/538
7,319,361 B2 * 1/2008 Jin ..... 327/543
7,417,490 B2 * 8/2008 Kim ..... 327/534
7,495,974 B2 * 2/2009 Kim ..... 365/194
7,590,023 B2 * 9/2009 Kim ..... 365/226
7,667,528 B2 * 2/2010 Kim ..... 327/534
7,724,076 B2 * 5/2010 Byeon ..... 327/541
7,821,330 B2 * 10/2010 Wang et al. ..... 327/538
2008/0080271 A1 * 4/2008 Kim ..... 365/194

FOREIGN PATENT DOCUMENTS

JP 2008-065672 3/2008
KR 1020070001726 1/2007
KR 1020080002528 1/2008
KR 100808053 2/2008

OTHER PUBLICATIONS

Notice of Preliminary Rejection issued from Korean Intellectual Property Office on Feb. 22, 2011.
Notice of Allowance issued by the Korean Intellectual Property Office on Dec. 26, 2011.
Office Action issued from the Japanese Patent Office on Sep. 30, 2014.

* cited by examiner

*Primary Examiner* — Patrick O'Neill
(74) *Attorney, Agent, or Firm* — IP & T Group LLP

(57) ABSTRACT

A semiconductor device is capable of generating an internal voltage having a voltage level that is dependent on an external power supply voltage. The semiconductor device includes an internal voltage generation unit configured to generate a plurality of internal voltages having different voltage levels by using an external power supply voltage, a voltage level detection unit configured to detect a voltage level of the external power supply voltage, and a selection unit configured to selectively output one of the internal voltages in response to a detection result of the voltage level detection unit.

10 Claims, 5 Drawing Sheets

INTERNAL VOLTAGE GENERATOR

CROSS-REFERENCE TO RELATED APPLICATIONS

The present application claims priority of Korean Patent Application No. 10-2009-0053511, filed on Jun. 16, 2009, the disclosure of which is incorporated herein by reference in its entirety.

BACKGROUND OF THE INVENTION

The present invention relates to a semiconductor design technology, and more particularly, to technology for generating an internal voltage by using an external power supply voltage.

Generally, semiconductor devices include an internal voltage generation circuit designed to generate a plurality of internal voltages by using an external power supply voltage in order to reduce power consumption and achieve efficient utilization of power.

When power is not stabilized. i.e., when the external power supply voltage starts to be supplied but does not reach a target voltage level, the internal voltages rise as a voltage level of the external power supply voltage rises. After the external power supply voltage that is supplied reaches the target voltage level, the internal voltages maintain a constant voltage level. Even though the external power supply voltage exceeds the target voltage level, the internal voltages are able to maintain the constant voltage level. When the external power supply voltage that is supplied reaches the target voltage level and thus the internal voltages are stabilized, the semiconductor device performs a reset operation and an internal operation.

Meanwhile, to improve the performance of the semiconductor device, the power supply voltage supplied to the semiconductor device may rise above the target voltage level. If the voltage level of the power supply voltage is increased for such an overclocking operation, the performance of the internal circuit using the increased power supply voltage is improved. However, the internal voltages generated from the internal voltage generation circuit of the semiconductor device maintain constant voltage levels even though the power supply voltage rises. Therefore, the performance of the internal circuits using the internal voltages as the operating voltages is not improved even though the power supply voltage rises.

SUMMARY OF THE INVENTION

An embodiment of the present invention is directed to providing a semiconductor device which is capable of generating an internal voltage having a voltage level that is dependent on an external power supply voltage.

In accordance with an aspect of the present invention, there is provided a semiconductor device, which includes a voltage level detection unit configured to detect a voltage level of an external power supply voltage, and an internal voltage generation unit configured to generate an internal voltage having a voltage level that is dependent on a detection result of the voltage level detection unit.

In accordance with another aspect of the present invention, there is provided a semiconductor device, which includes a level shifting unit configured to use an external power supply voltage as a driving voltage and output a plurality of second reference voltages having different voltage levels based on a first reference voltage, a voltage level detection unit configured to detect a voltage level of the external power supply voltage, a selection unit configured to selectively output one of the second reference voltages according to a detection result of the voltage level detection unit, and a voltage driving unit configured to drive an internal voltage terminal with an internal voltage having a voltage level corresponding to one of the second reference voltages outputted from the selection unit.

In accordance with further aspect of the present invention, there is provided a semiconductor device, which includes an internal voltage generation unit configured to generate a plurality of internal voltages having different voltage levels by using an external power supply voltage, a voltage level detection unit configured to detect a voltage level of the external power supply voltage, and a selection unit configured to selectively output one of the internal voltages in response to a detection result of the voltage level detection unit.

DESCRIPTION OF SPECIFIC EMBODIMENTS

Figure 1:
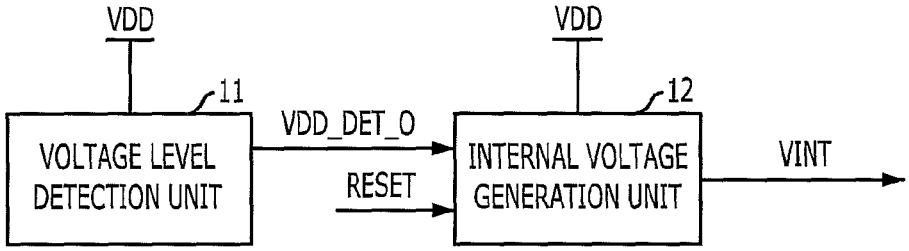
FIG. 1 illustrates a structure of a semiconductor device in accordance with a first embodiment of the present invention.

Other objects and advantages of the present invention can be understood by the following description, and become apparent with reference to the embodiments of the present invention. In the drawings and detailed description, since the terms, numerals, and symbols used to indicate devices or blocks may be expressed by sub-units, it should be noted that the same terms, numerals, and symbols may not indicate the same devices in a whole circuit.

Generally, logic signals of a circuit have a high level (H) and a low level (L) according to a voltage level and may be represented by "1" and "0." It can be assumed that, if necessary, the logic signals may further have a high impedance (Hi-Z) state. The p-channel metal oxide semiconductor (PMOS) and n-channel metal oxide semiconductor (NMOS) as referred to herein are types of metal oxide semiconductor field effect transistors (MOSFETs).

FIG. 1 illustrates a structure of a semiconductor device in accordance with a first embodiment of the present invention.

Referring to FIG. 1, the semiconductor device includes a voltage level detection unit 11 configured to detect a voltage level of an external power supply voltage VDD, and an internal voltage generation unit 12 configured to generate an internal voltage VINT having a voltage level that is dependent on a detection result VDD_DET_O of the voltage level detection unit 11.

The operation of the semiconductor device will be described below.

The internal voltage generation unit 12 generates an internal voltage VINT by using the power supply voltage VDD as a driving voltage. When the voltage level detection unit 11 outputs a result that the voltage level of the power supply voltage VDD increases, the internal voltage generation unit 12 increases the voltage level of the internal voltage VINT generated according to the detection result VDD_DET_0.

In accordance with the embodiment of the present invention, when the voltage level of the power supply voltage VDD is increased for the overclocking operation for the improvement of performance, the voltage level of the internal voltage VINT is also increased, which improves the performance of the internal circuit operating using the internal voltage VINT.

The internal voltage generation unit 12 is controlled by a reset signal RESET and generates the internal voltage VINT having a predefined voltage level in a reset enable period. That is, the internal voltage generation unit 12 outputs the internal voltage VINT having a constant voltage level, regardless of the detection result VDD_DET_O outputted from the voltage level detection unit 11.

Figure 2:
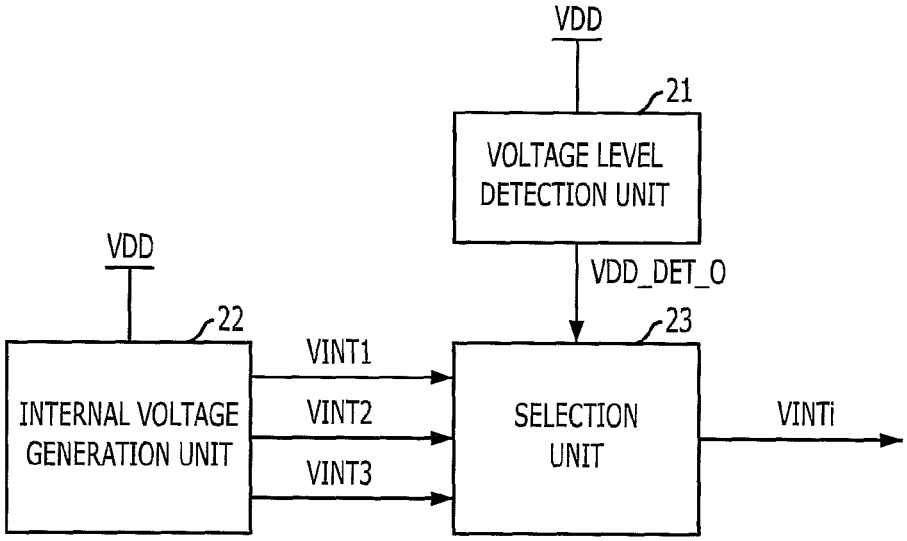
FIG. 2 illustrates a structure of a semiconductor device in accordance with a second embodiment of the present invention.

FIG. 2 illustrates a structure of a semiconductor device in accordance with a second embodiment of the present invention.

Referring to FIG. 2, the semiconductor device includes a voltage level detection unit 21, an internal voltage generation unit 22, and a selection unit 23. The internal voltage generation unit 22 generates a plurality of internal voltages VINT1, VINT2 and VINT3 having different voltage levels by using an external power supply voltage VDD. The voltage level detection unit 21 detects a voltage level of the power supply voltage VDD. The selection unit 23 selects the internal voltage VINTi according to a detection result VDD_DET_0 of the voltage level detection unit 21.

The operation of the semiconductor device of FIG. 2 will be described below.

The internal voltage generation unit 22 generates the plurality of internal voltages VINT1, VINT2 and VINT3 having different voltage levels by using the power supply voltage VDD as a driving voltage. The first internal voltage VINT1 among the internal voltages VINT1, VINT2 and VINT3 has the highest voltage level, and the third internal voltage VINT3 has the lowest voltage level. The second internal voltage VINT2 has the middle/medium voltage level.

The voltage level detection unit 21 detects the voltage level of the power supply voltage VDD to output the detection result VDD_DET_0. The selection unit 23 selectively outputs one of the internal voltages VINT1, VINT2 and VINT3 according to the detection result VDD_DET_0 of the voltage level detection unit 21. That is, assuming that the selection unit 23 outputs the second internal voltage VINT2 when the power supply voltage VDD maintains a target range, the selection unit 23 may output the first internal voltage VINT1 when the power supply voltage VDD rises above the target range, and output the third internal voltage VINT3 when the power supply voltage VDD falls below the target range.

As a result, the semiconductor device outputs the internal voltage VINTi that comparatively increase in proportion to the rise of the power supply voltage. Therefore, when the voltage level of the power supply voltage VDD is increased for the overclocking operation for the improvement of performance, the voltage level of the internal voltage VINTi is also increased, which improves the performance of the internal circuit operating using the internal voltage VINT.

Figure 3:
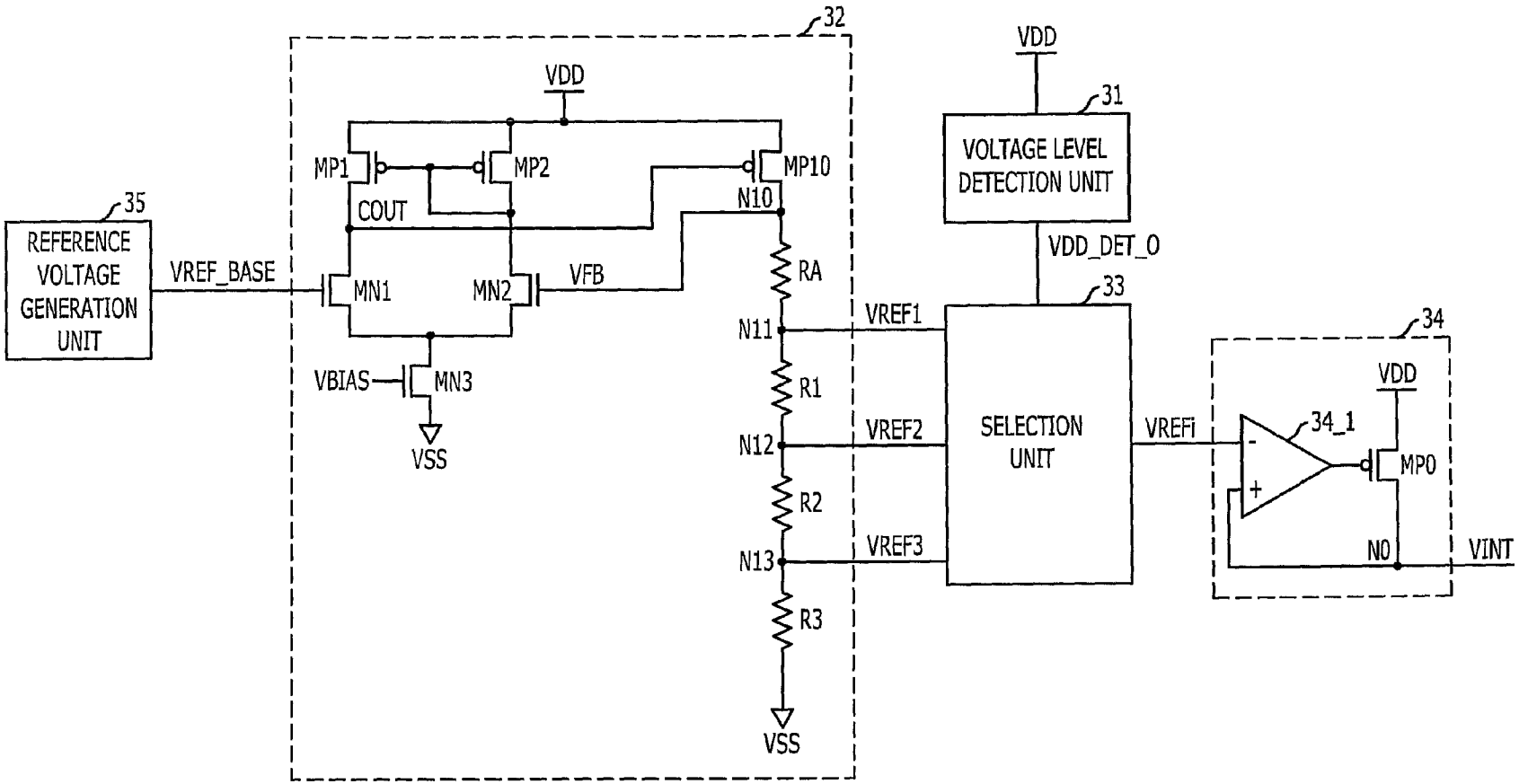
FIG. 3 illustrates a structure of a semiconductor device in accordance with a third embodiment of the present invention.

FIG. 3 illustrates a structure of a semiconductor device in accordance with a third embodiment of the present invention.

Referring to FIG. 3, the semiconductor device includes a voltage level detection unit 31, a level shifting unit 32, a selection unit 33, and a voltage driving unit 34. The level shifting unit 32 uses an external power supply voltage VDD as a driving voltage, and outputs a plurality of second reference voltages VREF1, VREF2 and VREF3 having different voltage levels based on a first reference voltage VREF_BASE. The voltage level detection unit 31 detects a voltage of the external power supply voltage VDD. The selection unit 33 selects the second reference voltage VREFi according to a detection result VDD_DET_O of the voltage level detection unit 31. The voltage driving unit 34 drives an internal voltage terminal with an internal voltage VINT of the voltage level corresponding to the second reference voltage VREFi outputted from the selection unit 33.

The semiconductor device may further include a reference voltage generation unit 35 configured to generate the first reference voltage VREF_BASE. The reference voltage generation unit 35 may be implemented with a bandgap reference circuit. The bandgap reference circuit is designed to generate a constant voltage regardless of process, voltage and temperature (PVT) variation.

On the other hand, the second reference voltages VREF1, VREF2 and VREF3 rise in proportion to the voltage level of the power supply voltage VDD, in an initial stage of supplying the power supply voltage. After the power supply voltage VDD reaches a target voltage level, the second reference voltages VREF1, VREF2 and VREF3 maintain constant voltage levels, respectively. Therefore, even though the power supply voltage VDD rises above the target voltage level, the second reference voltages VREF1, VREF2 and VREF3 maintain constant voltage levels, respectively.

The operation of the semiconductor device of FIG. 3 will be described below.

The level shifting unit 32 includes a comparison unit, a voltage output unit, and a feedback unit. The comparison unit compares the first reference voltage VREF_BASE with a feedback voltage VFB. The voltage output unit outputs the second reference voltages VREF1, VREF2 and VREF3 in response to an output signal COUT of the comparison unit. The feedback unit outputs the feedback voltage VFB having a voltage level corresponding to an output voltage of the voltage output unit. The comparison unit includes a differential amplification circuit implemented with a current mirror MP1 and MP2, a differential input unit MN1 and MN2 receiving the first reference voltage VREF_BASE and the feedback voltage VFB, and a biasing unit MN3 providing a bias current.

The voltage output unit includes a PMOS transistor MP10 and a plurality of voltage drop elements RA, R1, R2 and R3. The PMOS transistor MP10 is connected between a power supply voltage terminal (VDD) and a feedback node N10 and controlled by the output signal COUT of the comparison unit. The voltage drop elements RA, R1, R2 and R3 are connected between the feedback node N10 and a ground voltage terminal (VSS). Among the second reference voltages VREF1, VREF2 and VREF3 outputted by the voltage drop through the voltage drop elements RA, R1, R2 and R3, the first output voltage VREF1 has the highest voltage level, and the third output voltage VREF3 has the lowest voltage level. The second output voltage VREF3 has the middle voltage level.

Also, the feedback voltage VFB is a voltage outputted at the feedback node N10. Meanwhile, when the voltage level of the feedback voltage VFB rises, the output signal COUT of the comparison unit also rises. Since the output signal COUT of the comparison unit is inputted to a gate of the PMOS transistor MP10, the voltage level of the feedback voltage VFB is decreased as a result. That is, the feedback voltage VFB maintains a constant voltage level. While the feedback unit in accordance with the current embodiment of the present invention is implemented with a transmission line through which the feedback voltage VFB is transferred from the feedback node N10 to the first input terminal MN2 of the comparison unit, transistors or the like may be further included.

The voltage level detection unit 31 detects the voltage level of the power supply voltage VDD to output the detection result VDD_DET_0. The selection unit 33 selectively outputs one of the second reference voltages VREF1, VREF2 and VREF3 according to the detection result VDD_DET_0. That is, assuming that the selection unit 33 outputs the second output voltage VREF2 when the power supply voltage VDD maintains a target range, the selection unit 33 may output the first output voltage VREF1 when the power supply voltage VDD rises above the target range, and output the third output voltage VREF3 when the power supply voltage VDD falls below the target range.

The voltage driving unit 34 includes a unit gain buffer configured to receive the output voltage VREFi of the selection unit 33 to output the internal voltage VINT having the same voltage level as the output voltage VREFi of the selection unit 33. The voltage driving unit 34 includes a comparator 34_1 configured to compare the voltage of the internal voltage terminal N0 with the output voltage VREFi of the selection unit 33, and a driver MP0 configured to drive the internal voltage terminal N0 in response to an output signal of the comparator 34_1. The driver MP0 is implemented with a PMOS transistor controlled by the output signal of the comparator 34_1. When the output voltage VREFi of the selection unit 33 inputted to the comparator 34_1 is constant, the internal voltage terminal N0 is maintained at a constant voltage level by the comparator 34_1 and the driver MP0.

As a result, when the power supply voltage VDD rises, the internal voltage also rises in proportion to the power supply voltage VDD. That is, when the power supply voltage VDD rises, the selection unit 33 outputs the comparatively higher output voltage VREFi according to the detection result VDD_DET_0 of the voltage level detection unit 31. Finally, the voltage driving unit 34 drives the internal voltage terminal N0 with the internal voltage VINT having the same voltage level as the output voltage VREFi of the selection unit 33. Therefore, when the voltage level of the power supply voltage VDD is increased for the overclocking operation for the improvement of performance, the voltage level of the internal voltage VINTi is also increased, which improves the performance of the internal circuit operating using the internal voltage VINT.

Figure 4:
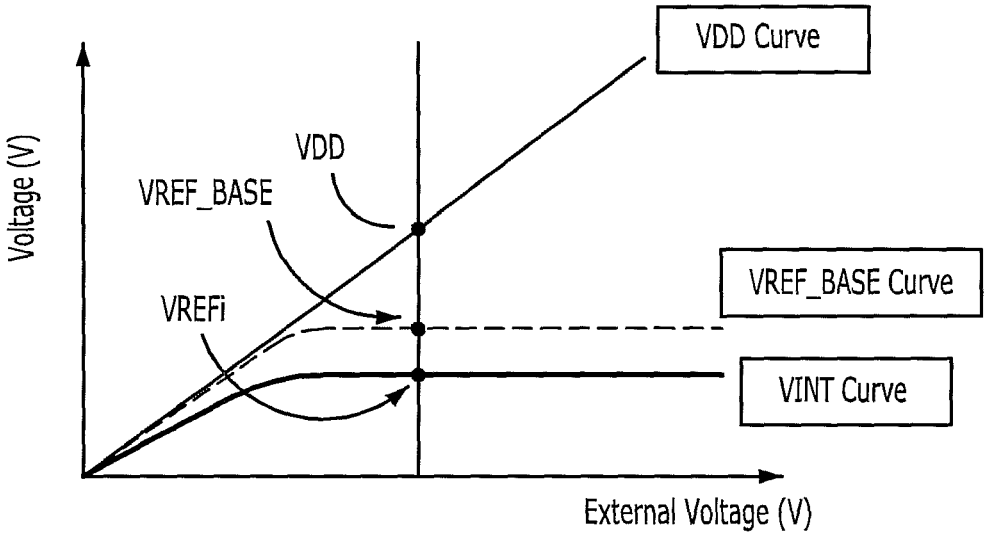
FIG. 4 is a graph showing a voltage relation of the semiconductor device in accordance with the third embodiment of the present invention.

FIG. 4 is a graph showing a voltage relation of the semiconductor device in accordance with the third embodiment of the present invention.

Referring to FIG. 4, if the power supply voltage VDD rises before the power is stabilized, the first reference voltage VREF_BASE rises in proportion to a variation of the power supply voltage VDD. After the power supply voltage VDD reaches the target voltage level, the first reference voltage VREF_BASE maintains a constant voltage level. Also, after the power supply voltage VDD reaches the target voltage level, the second reference voltage VREFi also maintains a constant voltage level, but a different second reference voltage VREFi may be selected according to the detection result VDD_DET_0. Assuming that the second reference voltage VREFi in FIG. 4 is outputted as the output voltage VREFi of the selection unit 33, the internal voltage VINT driven to the internal voltage terminal is finally selected to be different according to the detection result VDD_DET_0 as the output voltage VREFi of the selection unit 33.

Figure 5:
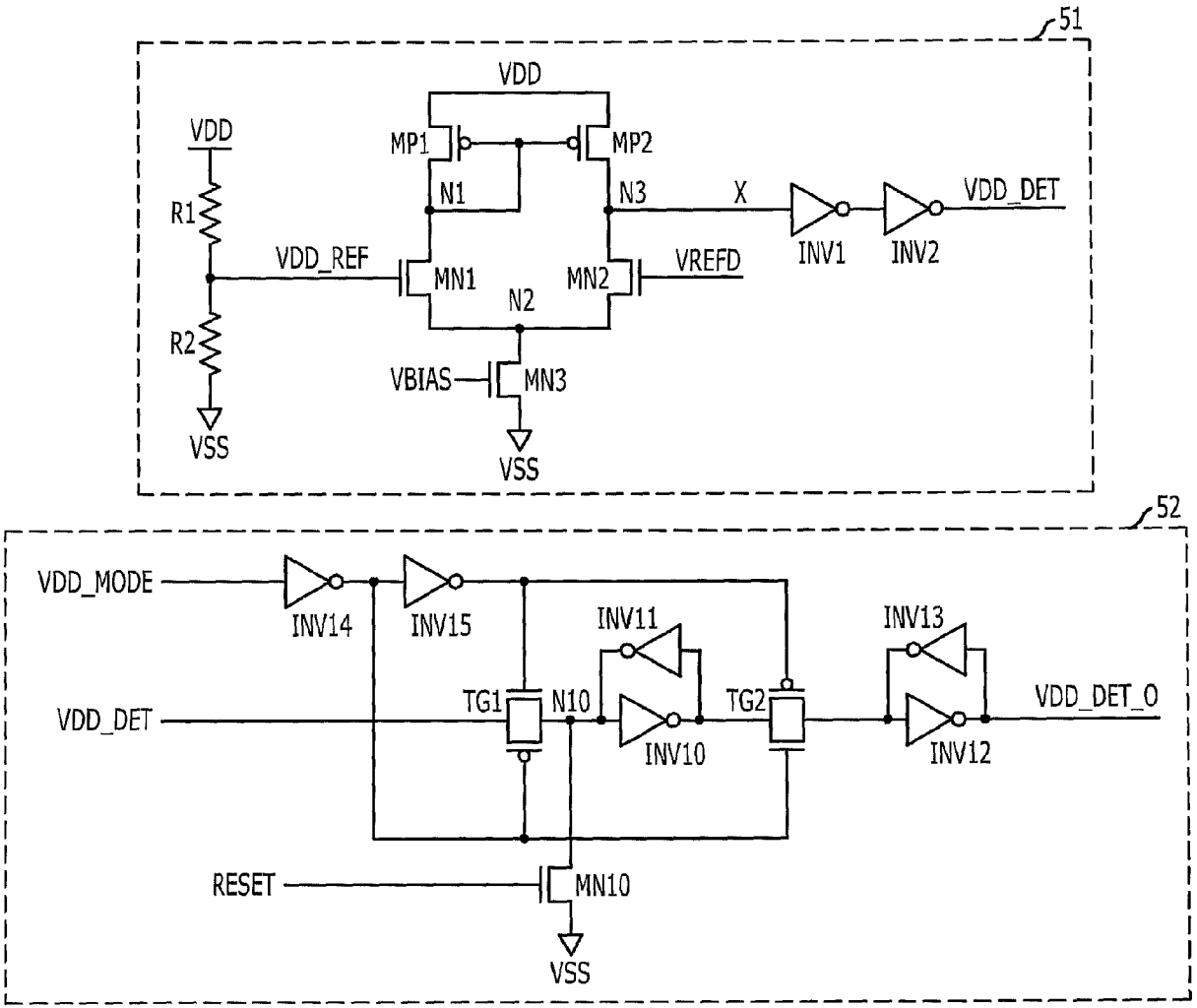
FIG. 5 is a circuit diagram of a voltage level detection unit of FIG. 3.

FIG. 5 is a circuit diagram of the voltage level detection unit of FIG. 3.

Referring to FIG. 3, the voltage level detection unit 31 includes a comparison unit 51 and a latch unit 52. The comparison unit 51 compares a reference voltage VREFD with a divided voltage VDD_REF generated by dividing the power supply voltage VDD, and outputs a voltage detection signal VDD_DET. The latch unit 52 latches the voltage detection signal VDD_DET outputted from the comparison unit 51 in response to a voltage detection mode signal VDD_MODE.

The detailed structure and operation of the voltage level detection unit will be described below.

The comparison unit 51 includes a plurality of voltage drop elements R1 and R2, a current mirror MP1 and MP2, a differential input unit MN1 and MN2, and a biasing unit MN3. The voltage drop elements R1 and R2 are connected between the power supply voltage terminal (VDD) and the ground voltage terminal (VSS) to output the divided voltage VDD_REF. The current mirror MP1 and MP2 is connected between the power supply voltage terminal (VDD) and first and second output terminals N1 and N3. The differential input unit MN1 and MN2 is connected between the first and second output terminals N1 and N3 and a first node N2 to receive the divided voltage VDD_REF and the reference voltage VREFD. The biasing unit MN3 provides a bias current to the first node N2. The biasing unit MN3 includes a NMOS transistor connected between the first node N2 and the ground voltage terminal (VSS) and controlled by a bias signal VBIAS, When the voltage level of the power supply voltage VDD rises, the voltage level of the divided voltage VDD_REF also rises. The potential of the first output terminal N1 falls, but the potential of the second output terminal N3 rises. Therefore, the voltage detection signal VDD_DET of a high level is outputted. That is, the voltage detection signal VDD_DET of a low level is outputted when the power supply voltage VDD maintains the target voltage level, and the voltage detection signal VDD_DET of a high level is outputted when the power supply voltage VDD rises above the target voltage level.

The latch unit 52 includes a first transmission gate TG1, a first latch INV10 and INV11, a second transmission gate TG2, and a second latch INV12 and INV13. The first transmission gate TG1 receives the voltage detection signal VDD_DET and is controlled by the voltage detection mode signal VDD_MODE. The first latch INV10 and INV11 latches an output signal of the first transmission gate TG1. The second transmission gate TG2 receives an output signal of the first latch INV10 and INV11 and is controlled by the voltage detection mode signal VDD_MODE. The second latch INV12 and INV13 latches an output signal of the second transmission gate TG2. The first transmission gate TG1 and the second transmission gate TG2 are oppositely turned on in response to the voltage detection mode signal VDD_MODE.

When the voltage detection mode signal VDD_MODE becomes a high level, the first transmission gate TG1 is turned on, and the voltage detection signal VDD_DET is latched in the first latch INV10 and INV11. When the voltage detection signal VDD_DET becomes a low level, the second transmission gate TG2 is turned on, and the signal latched in the first latch INV10 and INV11 is outputted through the second transmission gate TG2 and finally latched in the second latch INV12 and INV13.

Meanwhile, a reset unit MN10 for resetting the latch unit 52 may be connected to an input terminal N10 of the first latch INV10 and INV11. The reset unit MN10 is implemented with an NMOS transistor connected between the input terminal N10 of the first latch unit INV10 and INV11 and the ground voltage terminal (VSS) and controlled by a reset signal RESET. Therefore, in order to store and output an initial value other than the voltage detection signal VDD_DET, the latch unit 52 may be controlled by continuously applying the reset signal RESET of a high level. In this case, the output signal VDD_DET_0 of the latch unit 52, i.e., the detection result VDD_DET_0, maintains a low level.

Figure 6:
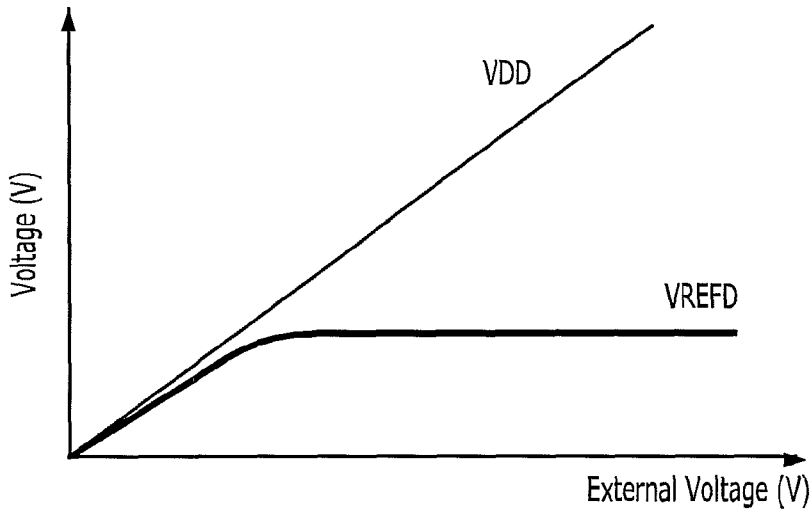
FIG. 6 is a graph showing a voltage relation of the voltage level detection unit of FIG. 5.

FIG. 6 is a graph showing a voltage relation of the voltage level detection unit of FIG. 5.

Referring to FIG. 6, at an initial phase, the reference voltage VREFD applied to the comparison unit 51 rises as the power supply voltage VDD rises. However, after the power supply voltage VDD reaches the target range, the reference voltage VREFD maintains a constant voltage level. Therefore, the comparison unit 51 can compare the variation of the power supply voltage VDD relative to the reference voltage VREFD.

Figure 7:
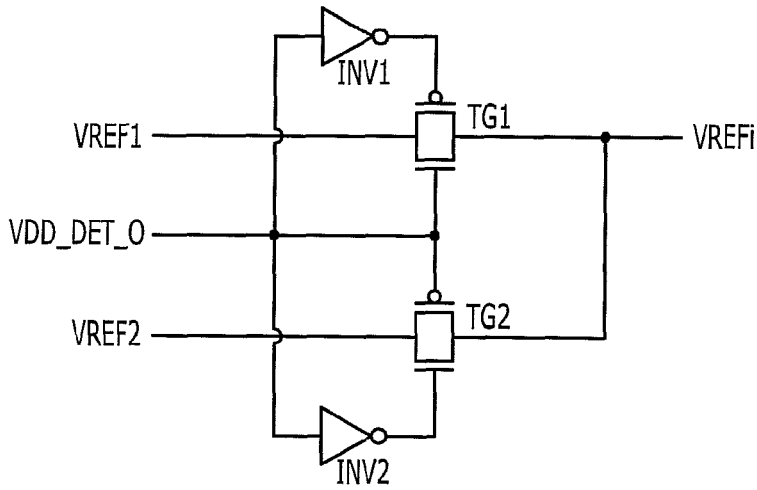
FIG. 7 is a circuit diagram of a selection unit of FIG. 3.

FIG. 7 is a circuit diagram of the selection unit of FIG. 3.

Referring to FIG. 7, the selection unit 33 includes a switching unit configured to output the second reference voltage VREFi selected among the plurality of second reference voltages VREF1, VREF2 and VREF3 by the detection result VDD_DET_0 outputted from the voltage level detection unit 31.

When the detection result VDD_DET_0 outputted from the voltage level detection unit 31 is a low level, a second transmission gate TG2 is turned on. Thus, the second reference voltage VREF2 inputted to the second transmission gate TG2 is outputted. When the detection result VDD_DET_0 outputted from the voltage level detection unit 31 is a high level, the second reference voltage VREF1 inputted to the first transmission gate TG1 is outputted.

The semiconductor device and the semiconductor memory device in accordance with the embodiments of the present invention detect the voltage level of the external power supply voltage and generate the internal voltage having a voltage level proportional to a variation of the voltage level of the power supply voltage. The performance of the internal circuit operating using the internal voltage can be also improved in the overclocking operation for improving the performance of the semiconductor device wherein the voltage level of the power supply voltage is increased.

While the present invention has been described with respect to the specific embodiments, it will be apparent to those skilled in the art that various changes and modifications may be made without departing from the spirit and scope of the invention as defined in the following claims.

For example, embodiments including additional structures may also be used to meet various design needs. Furthermore, the active high or active low structure representing the activation states of signals or circuits may be changed according to embodiments. Moreover, the configurations of the transistors may also be changed in order to implement the same functions. That is, the PMOS transistor and the NMOS transistor may be exchanged with each other and, if necessary, a variety of transistors may be used herein. In particular, although the above description has been made focusing on the overclocking operation to increase the voltage level of the power supply voltage, the present invention may also be applied to a semiconductor device designed to decrease the voltage level of the power supply voltage, decrease the voltage level of the internal voltage correspondingly and minimize the current consumption of the internal circuit using the internal voltage as the operating voltage. Numerous modifications can be made in the circuit configuration and can be easily deduced by those skilled in the art. Therefore, detailed explanation of such modification is omitted herein.

What is claimed is:

1. A semiconductor device, comprising:

a level shifting unit configured to use an external power supply voltage as a driving voltage and output a plurality of second reference voltages having different voltage levels based on a first reference voltage;

a voltage level detection unit configured to detect a voltage level of the external power supply voltage;

a selection unit configured to selectively output one of the second reference voltages according to a detection result of the voltage level detection unit; and a voltage driving unit configured to drive an internal voltage terminal with an internal voltage having a voltage level corresponding to one of the second reference voltages outputted from the selection unit.

2. The semiconductor device of claim 1, further comprising a reference voltage generation unit configured to generate the first reference voltage.

3. The semiconductor device of claim 2, wherein the reference voltage generation unit includes a bandgap reference circuit.

4. The semiconductor device of claim 1, wherein the plurality of second reference voltages each rises in proportion to a voltage rise of the external power supply voltage and maintains a constant voltage level after the external power supply voltage reaches a target voltage level.

5. The semiconductor device of claim 1, wherein the level shifting unit includes:

a comparison unit configured to compare the first reference voltage with a feedback voltage;

a voltage output unit configured to output the plurality of second reference voltages by dividing the external power supply voltage in response to an output signal of the comparison unit; and a feedback unit configured to output the feedback voltage having a voltage level corresponding to an output voltage of the voltage output unit.

6. The semiconductor device of claim 5, wherein the voltage output unit includes:

a transistor connected between a power supply voltage terminal and a first node and controlled by the output signal of the comparison unit; and a plurality of voltage drop elements connected between the first node and a ground voltage terminal.

7. The semiconductor device of claim 1, wherein the voltage level detection unit includes:

a comparison unit configured to compare a reference voltage with the voltage level of the external power supply voltage to output a voltage detection signal; and a latch unit configured to latch the voltage detection signal in response to a voltage detection mode signal.

8. The semiconductor device of claim 1, wherein the selection unit includes a switching unit configured to output the second reference voltage selected by the detection result of the voltage level detection unit.

9. The semiconductor device of claim 1, wherein the voltage driving unit includes a unit gain buffer configured to receive the second reference voltage outputted from the selection unit.

10. The semiconductor device of claim 1, wherein the voltage driving unit includes:

a comparison unit configured to compare a voltage of the internal voltage terminal with one of the second reference voltages outputted from the selection unit; and a driving unit configured to drive the internal voltage terminal in response to an output signal of the comparison unit.

* * * * *